US010418021B2

(12) United States Patent
Yamaguchi et al.

(10) Patent No.: US 10,418,021 B2
(45) Date of Patent: Sep. 17, 2019

(54) NOISE REDUCTION DEVICE, NOISE REDUCTION SYSTEM, AND NOISE REDUCTION CONTROL METHOD

(71) Applicant: Panasonic Intellectual Property Management Co., Ltd., Osaka (JP)

(72) Inventors: Takahiro Yamaguchi, Osaka (JP); Toshihiro Ezaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/901,119

(22) Filed: Feb. 21, 2018

(65) Prior Publication Data

US 2019/0259370 A1 Aug. 22, 2019

(51) Int. Cl.
*G10K 11/178* (2006.01)
*H04R 1/02* (2006.01)

(52) U.S. Cl.
CPC .. *G10K 11/17823* (2018.01); *G10K 11/17825* (2018.01); *H04R 1/025* (2013.01);
(Continued)

(58) Field of Classification Search
CPC ..... G10K 11/17823; G10K 11/17825; G10K 2210/1281; G10K 2210/3046;
(Continued)

(56) References Cited

U.S. PATENT DOCUMENTS 5,267,320 A * 11/1993 Fukumizu ..... G10K 11/178 381/71.12
9,226,066 B2 12/2015 Ohta et al.
(Continued)

FOREIGN PATENT DOCUMENTS

EP 0724762 8/1996
EP 2715719 4/2014
(Continued)

OTHER PUBLICATIONS

Extended European Search Report dated Aug. 27, 2018 in European Application No. 18157570.5.

*Primary Examiner* — Ping Lee
(74) *Attorney, Agent, or Firm* — Wenderoth, Lind & Ponack, L.L.P.

(57) ABSTRACT

A noise reduction device is connectable to a plurality of sound acquisition devices and a plurality of control sound output devices for reducing noises in a given space where seats are arranged and a sound field can be formed. The device includes a sound receiver, a processor, a control sound transmitter. The sound receiver receives a sound signal from at least two of the plurality of sound acquisition devices. The processor detects a state change of the sound field, and generates a control sound signal for reducing noise with respect to the sound signal. The control sound transmitter outputs the control sound signal to each of control sound output devices. The processor acquires, for example, seat information for specifying the reclining state of a seat. The processor controls the generation of the control sound signal based on the change of state of the sound field including the seat information.

9 Claims, 23 Drawing Sheets

(52) U.S. Cl.
CPC ..... *G10K 2210/1281* (2013.01); *G10K 2210/1283* (2013.01); *G10K 2210/3044* (2013.01); *G10K 2210/3046* (2013.01); *H04R 2499/13* (2013.01)

(58) Field of Classification Search
CPC ... G10K 2210/3044; G10K 2210/1283; H04R 1/025; H04R 2499/13
See application file for complete search history.

(56) References Cited

U.S. PATENT DOCUMENTS

| | | | | |
|---|---|---|---|---|
| 9,595,251 | B2 | 3/2017 | Whinnery | |
| 2010/0111317 | A1 | 5/2010 | Asao et al. | |
| 2010/0150367 | A1 | 6/2010 | Mizuno | |
| 2013/0208906 | A1* | 8/2013 | Asao ..... | G10K 11/178<br>381/71.4 |
| 2017/0186417 | A1 | 6/2017 | Maeda et al. | |

FOREIGN PATENT DOCUMENTS

| | | |
|---|---|---|
| EP | 2996111 | 3/2016 |
| JP | 5-333878 | 12/1993 |
| JP | 5327049 | 8/2013 |
| JP | 2017-116909 | 6/2017 |
| WO | 95/09415 | 4/1995 |
| WO | 2012/166386 | 12/2012 |

* cited by examiner

FIG. 8

| INDEX | DATA |
|---|---|
| SEAT NUMBER | 7C |
| MODE | BED |
| ANGLE | 170 DEGREES |
| WEIGHT | 70 KG |
| * * * | * * * |

FIG. 9

31a

| SEAT ANGLE | MODE |
|---|---|
| 110～150 | UPRIGHT |
| 151～160 | RELAX |
| 161～180 | BED |

FIG. 10

22a

| | SP 5L1/ 5L4 | SP 5L2/ 5L3 | SP 5U1/ 5U2/ 5U3/ 5U4 | MIC 7L11/ 7L41 | MIC 7L12/ 7L42 | MIC 7L21/ 7L31 | MIC 7L22/ 7L32 | MIC 7U51/ 7U53/ 7U61/ 7U63/ 7U71/ 7U73/ 7U81/ 7U83 | MIC 7U52/ 7U62/ 7U72/ 7U82 |
|---|---|---|---|---|---|---|---|---|---|
| UPRIGHT | OFF | OFF | ON | REF | REF | OFF | OFF | REF | ERR |
| RELAX | ON | ON | ON | REF | ERR | OFF | OFF | REF | ERR |
| BED | ON | ON | OFF | ERR | REF | ERR | REF | REF | REF |

FIG. 11

| INDEX | DATA |
| --- | --- |
| ACTION | RISE |
| ... | ... |

FIG. 12

| INDEX | DATA |
| --- | --- |
| RISE BUTTON | PRESS |
| RECLINE BUTTON | NONE |
| ... | ... |

NOISE REDUCTION DEVICE, NOISE REDUCTION SYSTEM, AND NOISE REDUCTION CONTROL METHOD

TECHNICAL FIELD

The present disclosure relates to a noise reduction device, a noise reduction system, and a noise reduction control method in a given space, for example, a noise reduction device, a noise reduction system, and a noise reduction control method for use inside closed structure bodies such as aircraft and railway vehicles.

BACKGROUND ART

For example, US Patent Application Publication 2010/111317A1 and Japanese Patent Application Laid-open No. H05-333878 discloses a noise reduction device in which a plurality of microphones are arranged around an adjustable (reclinable) seat and a control sound for reducing the noise collected by the microphone is outputted from the speaker. US Patent Application Publication 2017/186417A1 also discloses a technique in which the choice to use/nonuse of a plurality of microphones and speakers is made depending on whether the seat headrest is above or below the center.

BACKGROUND

In a case where the seat is adjustable, a control point (for example, the proximity of head of the person sitting on the seat), which is the target position of the noise reduction control, changes as the position of the seat changes. Alternatively, there are situations in which a microphone or a speaker is obstructed by other objects placed in front of them or by a part of the seat. In such a case, the functions of the microphone and speaker cannot be sufficiently exerted; thus incapable of obtaining noise reduction effect.

SUMMARY OF THE INVENTION

The present disclosure provides a noise reduction device, a noise reduction system, and a noise reduction control method, through which a noise reduction effect is effectively obtained in a given space where a sound field is formed.

A noise reduction device according to the present disclosure is a noise reduction device for reducing noise in a given space where a sound field can be formed, and connectable to a plurality of sound acquisition devices and a plurality of control sound output devices. The noise reduction device comprises a sound receiver, a processor, and a control sound transmitter. The sound receiver receives a sound signal from at least two of the plurality of sound acquisition devices. The processor detects a state change of the sound field, and generates a control sound signal for reducing noise with respect to the sound signal based on the change of state of the sound field. The control sound transmitter outputs the control sound signal to each of the control sound output devices.

With the noise reduction device, the noise reduction system, and the noise reduction control method according to the present disclosure, a noise reduction effect is effectively obtained in a given space where a sound field is formed.

BRIEF DESCRIPTION OF THE DRAWINGS

FIG. 8 shows an example of seat information.

FIG. 9 shows an example of information for specifying the reclining state of a seat.

FIG. 10 shows an example of an operation management table of a speaker and a microphone.

FIG. 11 shows an example of a control command from a seat control system.

FIG. 12 shows an example of instruction information in the seat control system.

DESCRIPTION OF EMBODIMENTS

Hereinafter, detailed descriptions of embodiments will be made with reference to the accompanying drawings deemed appropriate. However, descriptions in more detail than necessary will sometimes be omitted. For example, detailed descriptions of well-known items and duplicative descriptions of substantially the same configuration will sometimes be omitted.

Note that the accompanying drawings and the following descriptions are presented to facilitate fully understanding of the present disclosure by those skilled in the art, and are not intended to impose any limitations on the subject matter described in the appended claims.

First, a sound environment in aircraft 100 which requires installation of a noise reduction device is described with reference to FIGS. 1 and 2.

Figure 1:
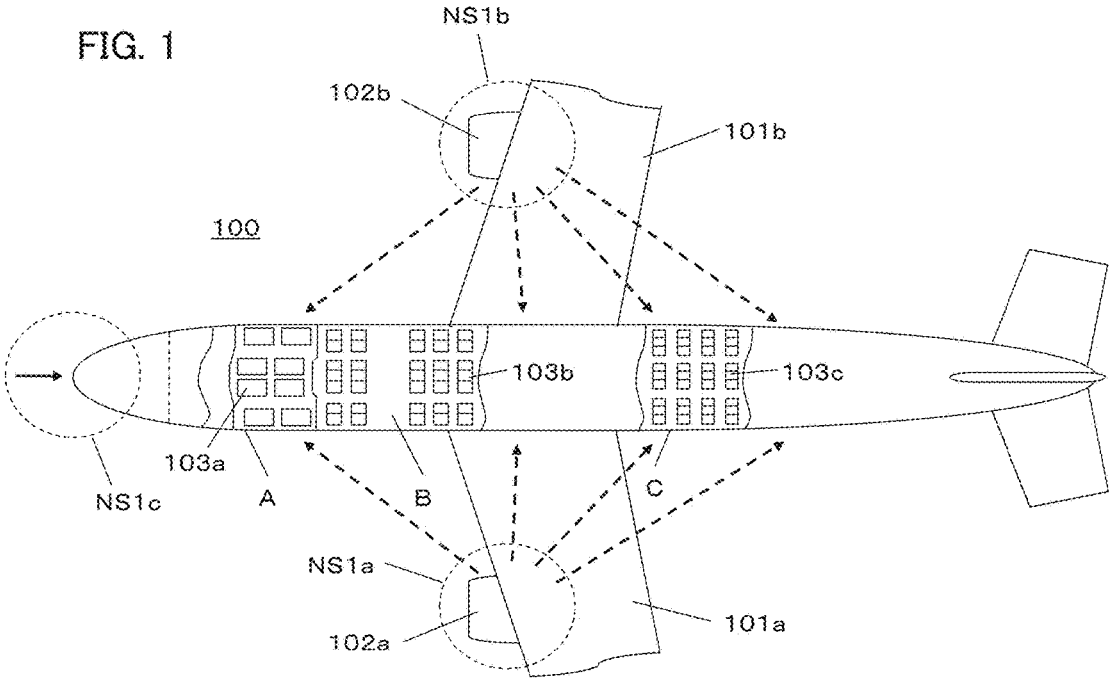
FIG. 1 schematically shows an aircraft as an installation environment for a noise reduction device.

FIG. 1 is a plan view illustrating the environment (on the inside of aircraft 100) in which a noise reduction device is installed according to the embodiment.

The aircraft 100 includes, as shown in FIG. 1, left and right wings 101*a* and 101*b*, and engines 102*a* and 102*b* mounted to wings 101*a* and 101*b*, respectively. Here, in view of the sound environment of the space inside the aircraft 100, sounds emitted from engines 102*a* and 102*b* have immense influences as noise sources because they contain sounds associated with reverberations of air streams during a flight as well as rotation sounds.

Engines 102*a* and 102*b* act as external noise sources NS1*a* and NS1*b* for seat rows 103*a*, 103*b*, and 103*c* which are arranged in, for example, cabin A (e.g. first class), cabin B (e.g. business class), and cabin C (e.g. economy class) of the aircraft, respectively. Moreover, high speed travelling of aircraft 100 entails an air-stream collision noise (wind noise) with the airframe's nose cone, the lateral side walls, and both wings 101*a* and 101*b*. Such a collision noise also acts as noise source NS1*c* for the cabin, resulting in bad influence on information service and the like in the cabin.

In addition, an air conditioning system (not shown) having pressurization, ventilation, and temperature adjustment functions is mounted on the aircraft 100 in order to clean, maintain, and circulate the air inside the aircraft. As shown in FIG. 2, the sound of the air conditioning system exists as a noise source NS2*a* in addition to the noise sources NS1*a*, NS1*b*, and NS1*c*.

Figure 2:
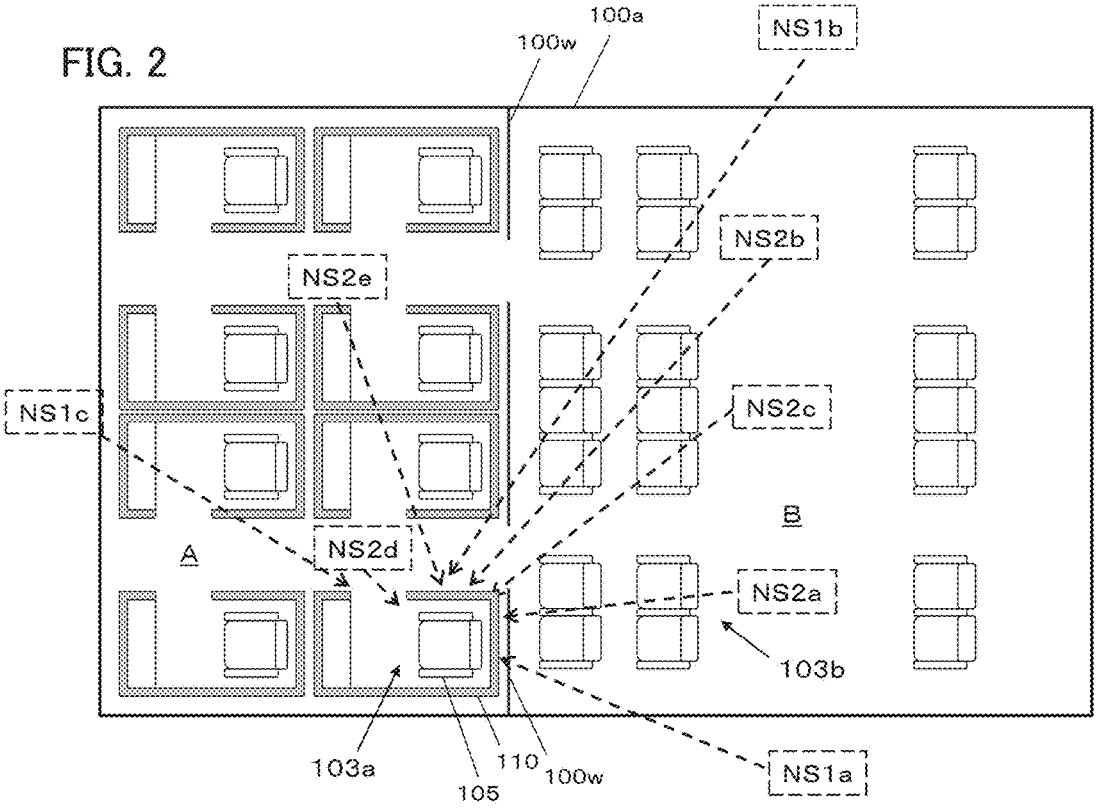
FIG. 2 shows an example of the installation environment for the noise reduction device in an aircraft.

FIG. 2 is a plan view illustrating details of the environment in which the noise reduction device is installed. FIG. 2 shows an enlarged illustration of the seat arrangement in a part of cabins A and B shown in FIG. 1.

Cabin 100*a* is sectioned by walls 100*w* into cabins A and B. In cabins A and B, seat rows 103*a* and 103*b* are disposed, respectively.

As to the sound environment of cabin 100*a*, the noise sources NS1*a* and NS1*b* generated from engines 102*a* and 102*b*, and the wind noise (noise source NS1*c*) generated at the airframe's nose cone, the lateral side walls, and both wings exist as external noise sources. In addition, noise sources NS2*a* to NS2*e* caused by the air conditioning system or the like are present as internal noise sources in cabin 100*a*.

For example, consider the noise at one seat 105 arranged in cabin A. The seat 105 is influenced by the noises which include ones from noise sources NS1*a* to NS1*c* caused by the air stream sound and engines 102*a*, 102*b* (see FIG. 1) mounted to the wings outside the window, and ones from noise sources NS2*a* to NS2*e* caused by the air conditioning system.

Figure 3:
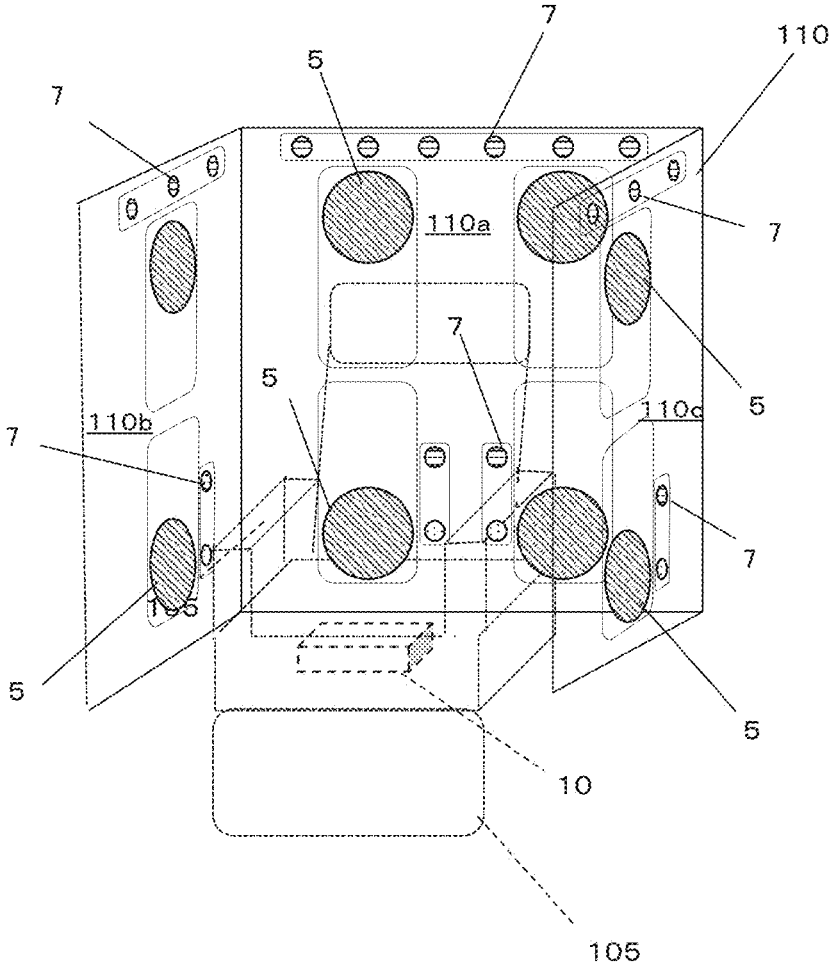
FIG. 3 shows an example of a shell structure to which the noise reduction device is applied.

In the first class or the like shown in cabin A in FIG. 1, the seat 105 is surrounded by a shell structure 110 as shown in FIG. 3. The inside of shell structure 110 is equipped with audio-visual appliances such as a television and radio receivers for entertaining a passenger with movies and music, a desk for a business person, a power receptacle for PCs, and so forth, thus forming a sound field. The seat 105 is strongly required to offer a passenger an excellent environment for relaxing comfortably, concentrating on business, etc. For this reason, noise reduction inside the shell structure 110 has been strongly demanded.

In a case where the seat 105 is adjustable, the input and output of the sound for noise reduction changes depending on the reclining state of the seat 105. Therefore, there is a possibility that the noise may not be effectively reduced. Furthermore, the microphones or speakers disposed in the shell structure 110 may be obstructed by objects such as a baggage or a part of the seat; thus the noise may not be effectively reduced. The noise reduction device according to the present disclosure can effectively reduce the noise even if the state of the sound field changes, which is caused by factors such as the reclining state of the seat 105, or the arrangement of objects in the shell structure 110.

Note that the reclining state of the seat 105 includes an inclined state of the backrest of the seat 105 with respect to the seat face. Also, the angle of the seat 105 (hereinafter referred to as the seat angle) includes the angle of the backrest of seat 105 with respect to the seat face.

An example of the seat 105 will be used for explanation in the following description; however the seat 105 does not mean a specific seat.

First Embodiment

A noise reduction system 1 including a noise reduction device 10 according to a first embodiment of the present disclosure will be described with reference to FIGS. 3 to 20; the description being made using an example of a case where the noise reduction system 1 is installed in an aircraft 100.

As shown in FIG. 3, the seat 105 is disposed inside the wall portion (back wall 110*a*, side walls 110*b* and 110*c*) of the shell structure 110 which is an example of a given space. The seat 105 is adjustable; the seat angle can be adjusted steplessly or in steps from an upright position to the fully-flat position. The noise reduction system 1 is disposed in the seat 105 and in the walls 110*a* to 110*c*.

The noise reduction system 1 includes the noise reduction device 10, a speaker 5 which is an example of a control sound output device, and a microphone 7 which is an example of a sound acquisition device. The noise reduction device 10 is installed inside the seat 105, for example, below the seat face. The noise reduction device 10 is connectable to a plurality of speakers 5 and a plurality of microphones 7. The plurality of speakers 5 and microphones 7 are arranged at predetermined positions of the walls 110*a* to 110*c* of the shell structure 110 that surrounds the seat 105. Here, the plurality of speakers 5 and microphones 7 being disposed at predetermined positions includes being arranged in the upper and lower part of the shell structure 110.

The plurality of microphones 7, to be described later, are determined to be set as either error microphones or noise microphones according to seat information. The noise microphone is an example of a noise acquisition device, and is a microphone for detecting a sound emitted from a noise source. The error microphone is an example of an error sound acquisition device, and is a microphone for detecting a residual sound (error sound) which is a result of superimposing a control sound emitted from the speaker 5 onto the sound emitted from a noise source. The control sound is a sound signal generated so as to cancel out the noise.

1-1 Configuration

The noise reduction system 1 controls both the generation of a control sound and the input/output of sound based on seat information transmitted from a seat control system 3. Specifically, the noise reduction system 1 is formed by the following configuration.

Figure 4:
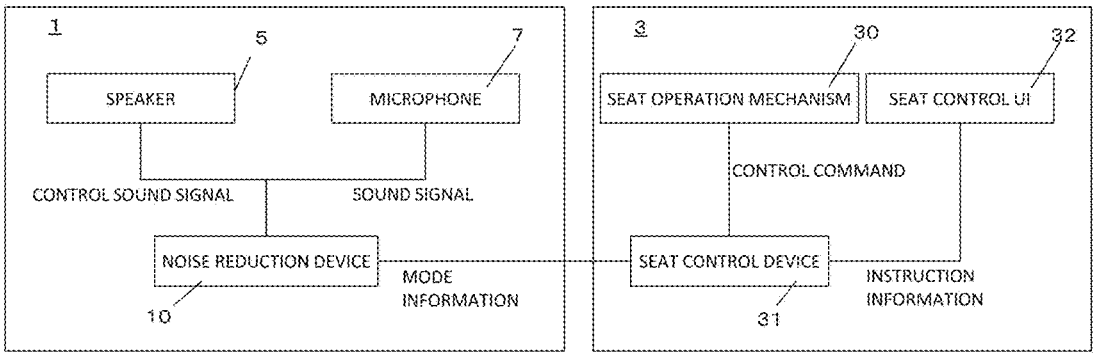
FIG. 4 schematically shows a configuration of a noise reduction system.

The noise reduction system 1 includes the noise reduction device 10, speakers 5, and microphones 7 as shown in FIG. 4.

Figure 5:
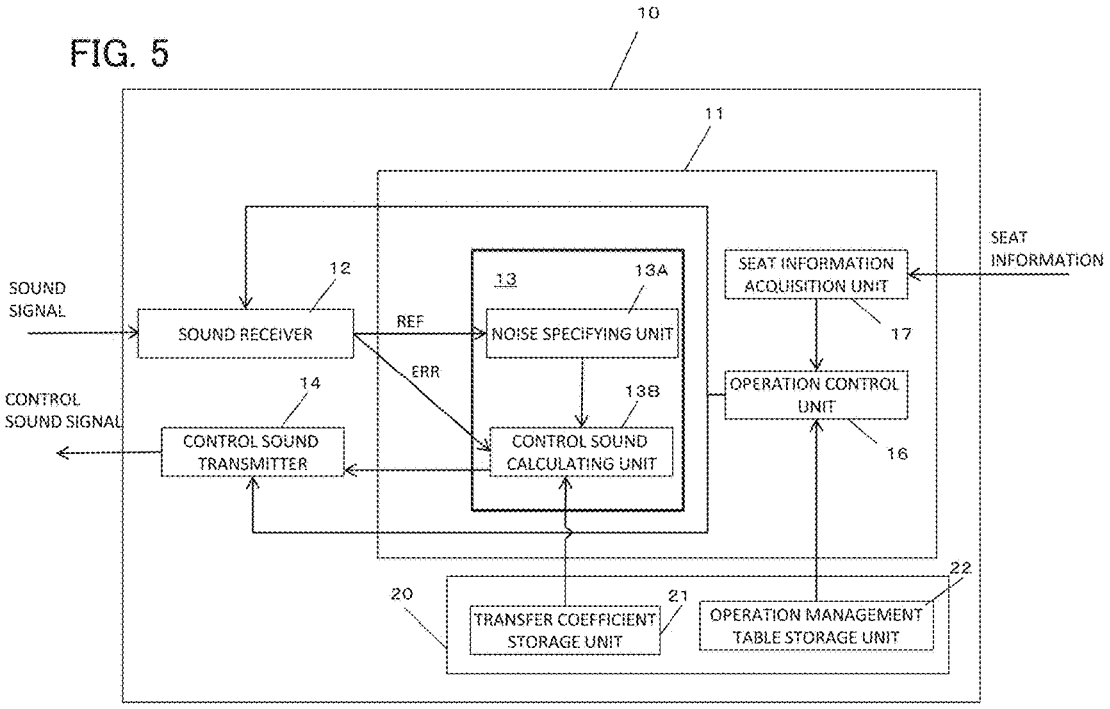
FIG. 5 is a functional block diagram of the noise reduction device.

As shown in FIG. 5, the noise reduction device 10 includes a processor 11 including a signal processing circuit such as a Digital Signal Processor (DSP), a sound receiver 12 connectable to the respective microphones 7, a control sound transmitter 14 connectable to the respective speakers 5, and a memory 20. The processor 11 includes, for example, a digital filter such as an Finite Impulse Response (FIR) or an adaptive filter for processing the audio signal from the respective microphones 7. The processor 11 processes the digital signal according to a predetermined algorithm, thereby allowing the processor 11 to perform functions of a control sound generating unit 13, an operation control unit 16, and a seat information acquisition unit 17, which will be described later.

The sound receiver 12 receives a sound signal from each of the microphones 7, applies A/D conversion and performs encoding processing on the sound signal. The sound receiver 12 has a number of channels corresponding to the number of microphones 7. Processing by the control sound generating unit 13 of the sound signal received by the sound receiver 12, to be described later, is changed according to an instruction from the operation control unit 16. The sound receiver 12 also switches the input of the sound signal from the respective microphones 7 to ON or OFF according to an instruction from the operation control unit 16, which will be described later.

The control sound generating unit 13 includes a noise specifying unit 13*a* and a control sound calculating unit 13*b*.

The noise specifying unit 13*a* analyzes the frequency of the sound signals from the noise microphones out of the plurality of microphones 7, and specifies the noise signal, which is the frequency band to be canceled out, from out of the sound signals obtained from each noise microphone.

The control sound calculating unit 13*b* reads a transfer coefficient stored in a transfer coefficient storage unit 21 of the memory 20. The transfer coefficient is a coefficient based on the transfer function from the speaker 5 to the error microphone. The control sound calculating unit 13*b* generates a control sound signal having an opposite phase to the noise signal advanced by the transfer coefficient. For example, the control sound calculating unit 13*b* adjusts the filter coefficient of the digital filter so that the error sound from the error microphone among the plurality of microphones 7 is minimized. This adjustment allows the error between the control sound and the noise signal at the control point to be minimized, thereby maintaining the effect of noise reduction.

The control sound transmitter 14 has a number of channels corresponding to the number of speakers 5. With this configuration, the control sound transmitter 14 outputs the control sound signal, which is generated by the control sound generating unit 13, to the respective speakers 5 after D/A conversion. The control sound outputted from the speakers 5 cancels the noise in the proximity of the user on the seat. The control sound transmitter 14, to be described later, switches the output of the sound signal to the respective speakers 5 to ON or OFF according to an instruction from the operation control unit 16.

In accordance with the seat information from the seat control system 3, the operation control unit 16 determines the operation and type of operation for the respective speakers 5 and the respective microphones 7, and issues commands to the sound receiver 12 and the control sound transmitter 14. The switching of operation includes switching the output of the control sound signals to the speakers 5 to ON or OFF, and switching the input of sound signals from the microphones 7 to ON or OFF. The switching of the type of operation includes determining the microphones 7 to be set as noise microphones or error microphones, and causing the control sound generating unit 13 to generate a control sound in accordance with the determination. More specifically, when a sound signal is received from the noise microphone, the sound signal is processed by the noise specifying unit 13*a*, and then filtered by the control sound calculating unit 13*b*, so that a control sound signal is generated. When a sound signal is received from the error microphone, the coefficient of the filter is adjusted by the control sound generating unit 13 in order to minimize the sound signal which is the error sound.

The seat information acquisition unit 17 is an example of a detecting unit for detecting a change in the state of a sound field formed in the shell structure 110, and acquires seat information received from the seat control system 3. The seat information will be described later.

Figure 6:
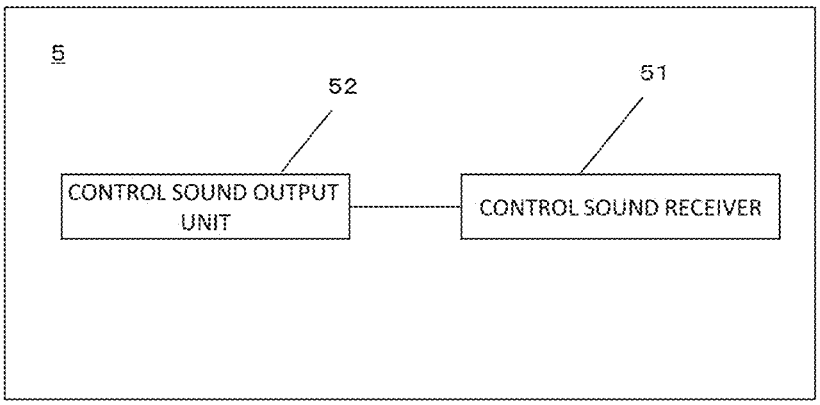
FIG. 6 is a functional block diagram of a speaker.

Each of the speakers 5 includes a control sound receiver 51 and a control sound output unit 52 as shown in FIG. 6. The control sound receiver 51 receives the control sound signal transmitted from the noise reduction device 10. The control sound output unit 52 amplifies the control sound and outputs it.

Figure 7:
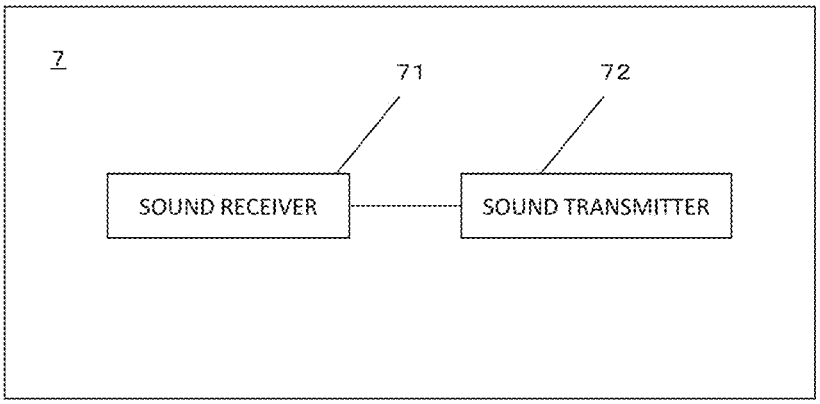
FIG. 7 is a functional block diagram of a microphone.

As shown in FIG. 7, each of the microphones 7 includes a sound receiver 71 and a sound transmitter 72. The sound receiver 71 acquires sound from the noise source and the sounds emitted from the respective speakers 5. The sound transmitter 72 converts the sound acquired by the sound receiver 71 into an electric signal, and transmits the electric signal as a sound signal to the noise reduction device 10.

It is to be noted that switching the ON/OFF operation of outputting the control sound signal to the respective speakers 5 and inputting of the sound signal from the respective microphones 7 is not limited to activating and deactivating the input/output of signals by the noise reduction device 10. The noise reduction device 10 may control the ON/OFF of the power of the speakers 5 and the microphones 7.

FIG. 8 shows an example of seat information. The seat information includes information specifying the reclining state of the seat. The seat information may include, for example, information such as a seat number, mode information indicating the reclining state of the seat, seat angle, and weight information. The information containing seat angle or mode information is updated every time there is a change to the seat position. FIG. 9 shows the mode information 31*a* of the seat. For example, the seat has an "upright" mode, a "relax" mode, and a "bed" mode. In the upright mode, the backrest of the seat is substantially upright and the seat angle is, for example, in the range of 110 to 150 degrees. In the bed mode, the backrest of the seat is in a substantially flat state, and the seat angle is, for example, in the range of 161 to 180 degrees. In the relax mode, the backrest of the seat is inclined at an angle between the bed mode and the upright mode, and the seat angle is, for example, in the range of 151 to 160 degrees. Note that the range of the seat angle corresponding to each mode is not limited to this. For instance, the range of the seat angle in the upright mode or the bed mode may be smaller, or the range of the seat angle in the relax mode may be larger.

FIG. 10 shows an example of an operation management table referred to by the operation control unit 16. An operation management table 22*a* is stored in an operation management table storage unit 22 (FIG. 5). Referring to the operation management table 22*a* based on the seat information, the operation control unit 16 determines the operation and type of operation for the respective speakers 5 and the respective microphones 7. Specifically, the operation control unit 16 switches the output of the speakers 5 and the input of the microphones 7 to ON or OFF according to seat information. In accordance with the seat information, the operation control unit 16 determines whether the microphones 7 will be set as noise microphones or error microphones. Note that in the operation management table 22*a*, the symbol "REF" indicates a noise microphone and the symbol "ERR" indicates an error microphone.

In the present embodiment, out of the seat information, mode information is used as information for specifying the reclining state of the seat; however, the present disclosure is not limited to this. For example, the operation control unit 16 may directly obtain information on the seat angle and switch the operation and type of operation of the respective speakers 5 and the respective microphones 7 according to the angle. The seat angle may be acquired from an acceleration sensor provided in the seat, for example. Furthermore, information of the seat angle may also be acquired by calculating the seat angle from the change in the weight on the backrest or the seat face based on the weight information for the seat.

Also, the mode information of the seat is not limited to the above, and the number of modes may be more or less than that of the above example. For example, the mode may be only two types: the upright mode and the bed mode.

As shown in FIG. 4, the noise reduction system 1 is connectable to the seat control system 3. The seat control system 3 is installed in the seat 105 and includes a seat operation mechanism 30, a seat control device 31, and a seat control user interface (UI) 32. The seat operation mechanism 30 is a mechanism that changes the seat angle of the seat 105 according to a control command from the seat control device 31. The seat control device 31 includes a processor such as a CPU and a memory, and operates according to a predetermined program. The processor may be either single or plural. In response to an instruction information from the seat control UI 32, the seat control device 31 issues a control command to the seat operation mechanism 30. For example, as shown in FIG. 11, the control command indicates the contents of the operation to the seat operation mechanism 30. The seat control device 31 also transmits the seat information corresponding to the instruction information from the seat control UI 32 to the noise reduction system 1. The seat control UI 32 is a part operated by the user, that is, a button, a switch, or a lever for example. The seat control UI 32 may be provided on a display having a touch panel as an operation part. The instruction information issued by the seat control UI 32 is instruction information corresponding to the operation of the various buttons, as shown in FIG. 12, for example.

Figure 13:
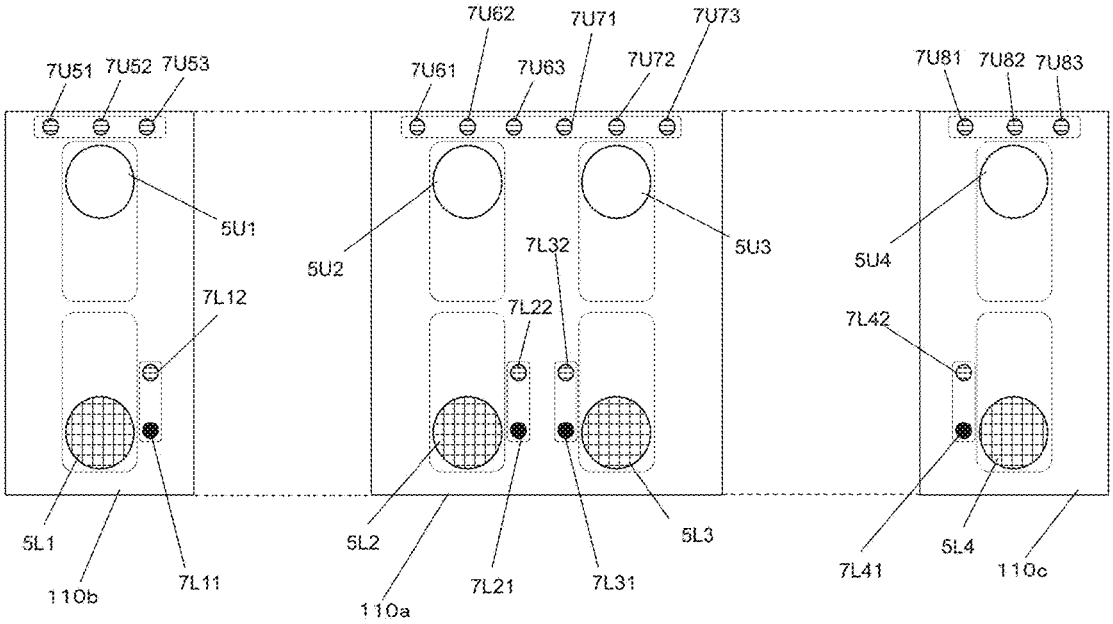
FIG. 13 shows an example of operating states of a speaker and a microphone, respectively, when the seat is in a bed mode.
Figure 14:
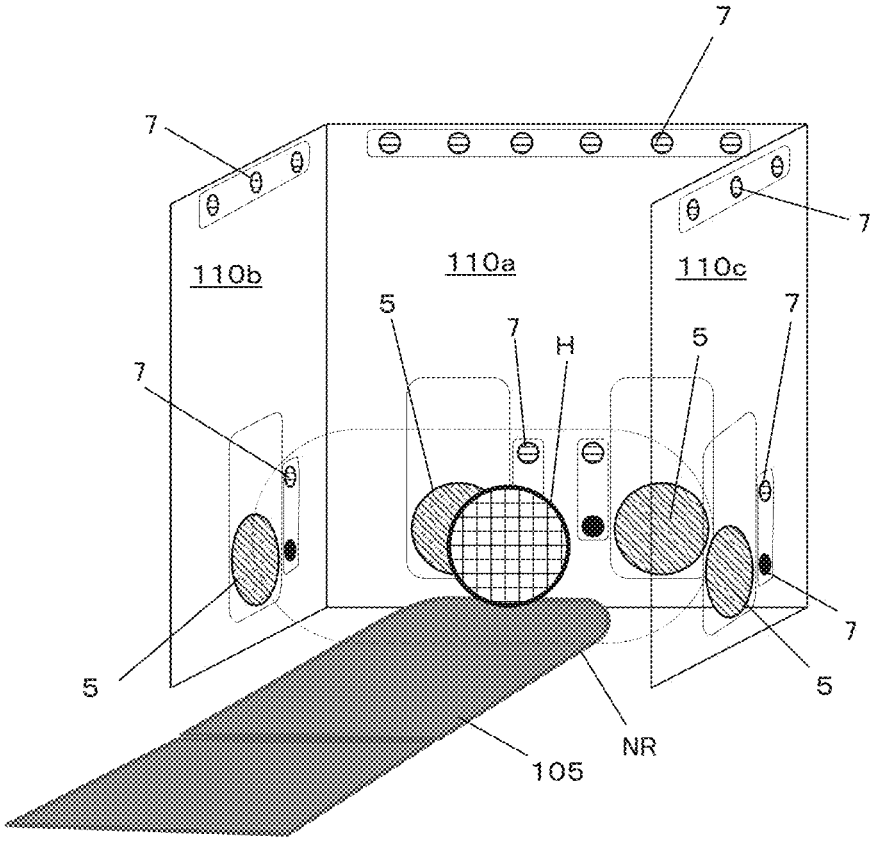
FIG. 14 shows a state of the seat to which the operation state of FIG. 13 is applied.

FIG. 13 and FIG. 14 are views schematically showing the operation states of the respective speakers 5 and respective microphones 7 when the seat 105 is in the bed mode according to the operation management table 22*a* of FIG. 10. When the seat 105 is in the bed mode, the outputs of speakers 5U1, 5U2, 5U3, and 5U4 are switched to OFF, the speakers being disposed in the upper part of walls 110*a* to 110*c* of the shell structure 110 surrounding the seat 105. The outputs of speakers 5L1, 5L2, 5L3, and 5L4 disposed in the lower part of the walls 110*a* to 110*c* are switched to ON. Microphones 7U51, 7U52, 7U53, 7U61, 7U62, 7U63, 7U71, 7U72, 7U73, 7U81, 7U82, and 7U83 disposed in the upper part of the walls 110*a* to 110*c* are set as noise microphones. Likewise, among the microphones 7 arranged vertically and disposed in the lower part of the walls 110*a* to 110*c*, the ones at the top, that is, microphones 7L12. 7L22, 7L32, and 7L42 are set as noise microphones. Therefore, the sound signal acquired from these microphones is specified as noise by the noise specifying unit 13*a*, and then processed by the control sound calculating unit 13*b*, so that the control sound signal is generated. In contrast, microphones 7L11, 7L21, 7L31, and 7L41 located at the lowermost position are set as error microphones. Therefore, the sound signal acquired from these microphones is regarded as an error sound. In order to minimize the error sound, the coefficient of the filter is adjusted by the control sound calculating unit 13*b*. In the bed mode, the backrest of the seat 105 becomes nearly flat, and a user's head H, which is the control point, is located at the lower part the shell structure 110. Therefore, the noise is effectively cancelled by the control sound from the speakers 5 the outputs of which are switched to ON. However, since the upper speakers 5U1, 5U2, 5U3, and 5U4 are distant from the control point, the effect of noise reduction is small even when the control sound is outputted from these speakers. Thus, the outputs of these upper speakers 5U1, 5U2, 5U3, and 5U4 are switched to OFF. With this configuration, extra power consumption can be suppressed and adverse influence on the effect of noise reduction can be reduced. Furthermore, the error sound that remains after noise reduction can be effectively acquired by using the microphones 7L11, 7L21, 7L31, and 7L41 located at positions near the control point as error microphones.

Figure 15:
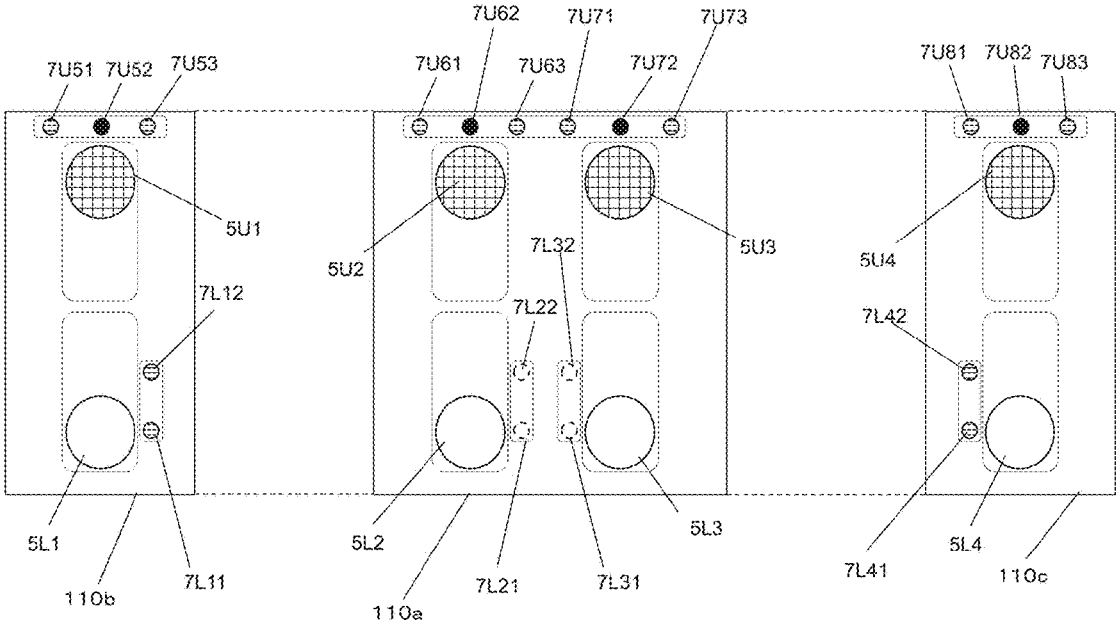
FIG. 15 shows an example of operating states of a speaker and a microphone, respectively, when the seat is in an upright mode.
Figure 16:
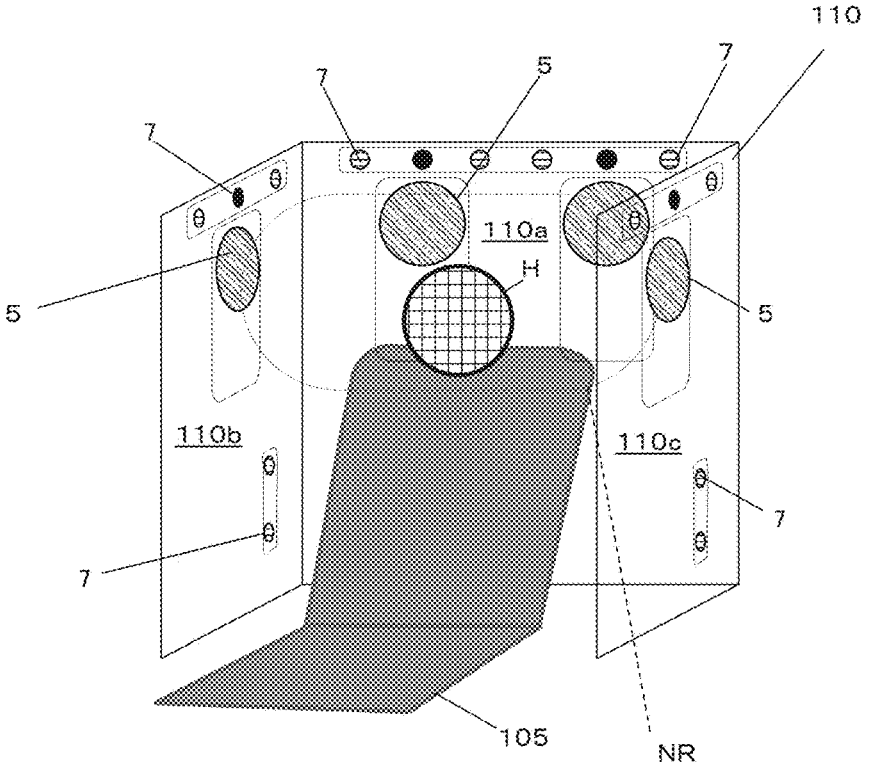
FIG. 16 shows a state of the seat to which the operation state of FIG. 15 is applied.

FIG. 15 and FIG. 16 are views schematically showing the operation states of the respective speakers 5 and respective microphones 7 when the seat 105 is in the upright mode according to the operation management table 22*a* of FIG. 10. When the seat 105 is in the upright mode, the outputs of the speakers 5U1, 5U2, 5U3, and 5U4 disposed in the upper part of the walls 110*a* to 110*c* are switched to ON. The outputs of the speakers 5L1, 5L2, 5L3, and 5L4 disposed in the lower part of the walls 110*a* to 110*c* are switched to OFF. The microphones 7U51, 7U52, 7U53, 7U61, 7U62, 7U63, 7U71, 7U72, 7U73, 7U81, 7U82, and 7U83 disposed in the upper part of the walls 110*a* to 110*c* are alternately set as noise microphones and error microphones. The microphones 7L11, 7L12, 7L41, and 7L42 arranged vertically in the lower part of the side walls 110*b* and 110*c* on both sides of the seat 105 are set as noise microphones. The inputs of the microphones 7L21, 7L22, 7L31, and 7L32 arranged vertically in the lower part of the back wall 110*a* behind the seat 105 are switched to OFF. In the upright mode, the speakers 5U1, 5U2, 5U3, and 5U4 in the upper part of the shell structure 110 are close to the position of the head H of the user, which is the control point. Therefore, the noise is effectively cancelled by the control sound from the speakers 5. However, since the lower speakers 5L1, 5L2, 5L3, and 5L4 are distant from the control point, the effect of noise reduction is small even when the control sound is outputted from these speakers. Thus, the outputs of these lower speakers 5L1, 5L2, 5L3, and 5L4 are switched to OFF. With this configuration, extra power consumption can be suppressed and adverse influence on the effect of noise reduction can be reduced. In addition, the error sound that remains after noise reduction can be effectively acquired by alternately arranging the microphones 7 that are at positions near the control point as noise microphones and error microphones. Moreover, the microphones 7L21, 7L22, 7L31, and 7L32 are located at positions where they may be obstructed by the backrest of the seat and give little noise reduction effect, and the inputs of these microphones are switched to OFF, which allows extra power consumption and adverse influence on noise reduction effect to be suppressed.

Figure 17:
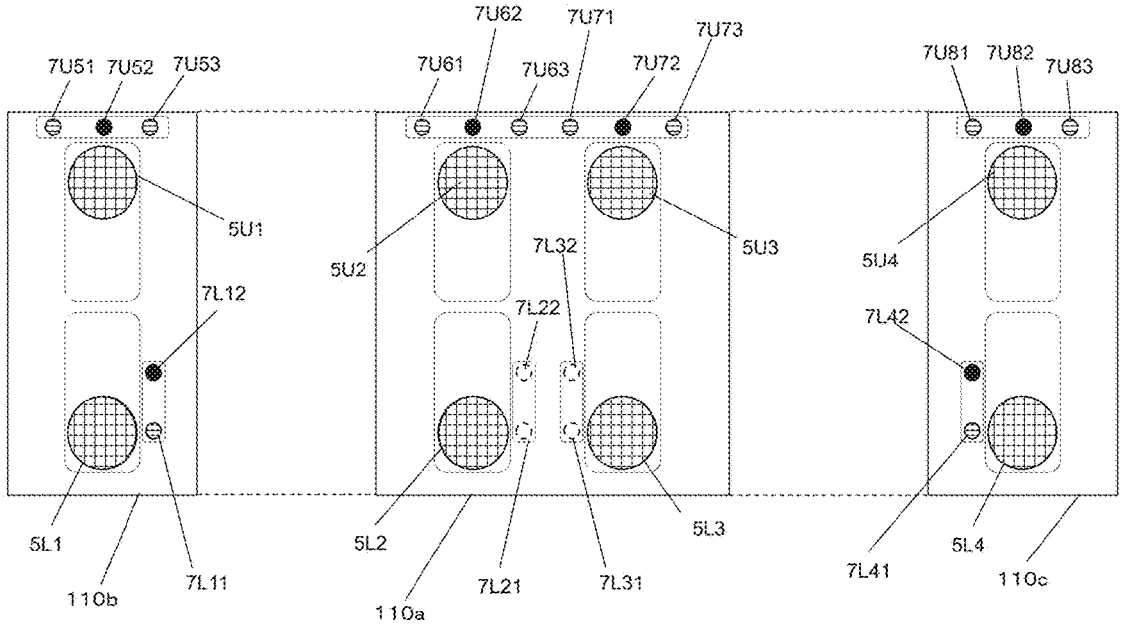
FIG. 17 shows an example of operating states of a speaker and a microphone, respectively, when the seat is in a relax mode.
Figure 18:
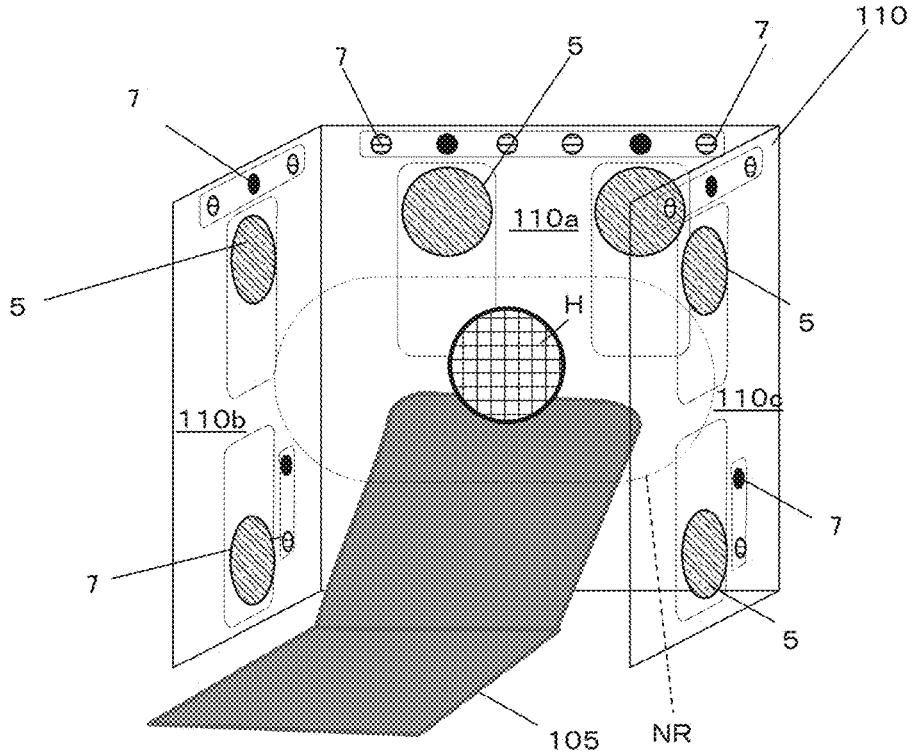
FIG. 18 shows a state of the seat to which the operation state of FIG. 17 is applied.

FIG. 17 and FIG. 18 are views schematically showing the operation states of the respective speakers 5 and respective microphones 7 when the seat 105 is in the relax mode according to the operation management table 22*a* of FIG. 10. When the seat 105 is in the relax mode, the outputs of all the speakers 5U1, 5U2, 5U3, 5U4, 5L1, 5L2, 5L3, and 5L4 disposed in the upper part and lower part of the walls 110*a* to 110*c* are switched to ON. The microphones 7U51, 7U52, 7U53, 7U61, 7U62, 7U63, 7U71, 7U72, 7U73, 7U81, 7U82, and 7U83 disposed in the upper part of the walls 110*a* to 110*c* are alternately set as noise microphones and error microphones. Of the microphones 7 arranged vertically in the lower part of the side walls 110*b* and 110*c* on both sides of the seat 105, the upper microphones 7L12 and 7L42 are set as error microphones whereas the bottom microphones 7L11 and 7L41 are set as noise microphones. The inputs of the microphones 7L21, 7L22, 7L31, and 7L32 arranged vertically in the lower part of the back wall 110*a* behind the seat 105 are switched to OFF. In the relax mode, the seat 105 is in the state with its seat angle is inclined to 151 to 160 degrees. Given this situation, the head H of the user, which is the control point, is positioned approximately in the middle in the vertical direction of the walls 110*a* to 110*c*. Therefore, the outputs of all the speakers 5, which are located above and below the control point, are switched to ON. The microphones 7L12 and 7L42 on the side walls 110*b* and 110*c* and located at intermediate positions close to the control point are set as error microphones. The inputs of the microphones 7L21, 7L22, 7L31, and 7L32 on the back wall 110*a* are switched to OFF since they are almost obstructed by the backrest.

1-2 Operation

Figure 19:
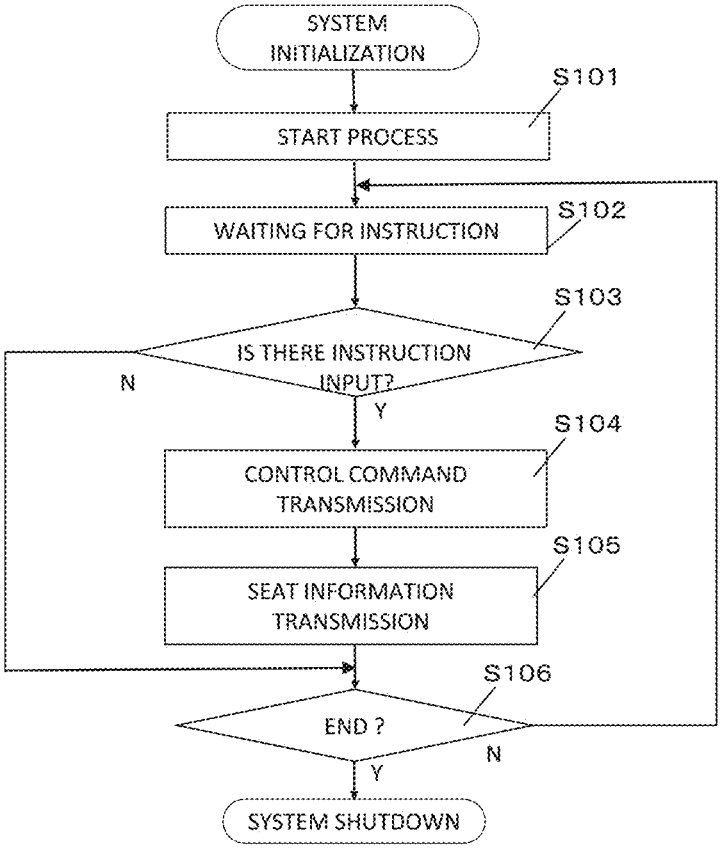
FIG. 19 is a flowchart illustrating an operation of a seat control system.

FIG. 19 is a flowchart illustrating an operation of the seat control system 3 according to the present embodiment. First, the seat control system 3 is in the initialization state. This initialization state is, for example, a state immediately after takeoff of the aircraft 100, and the seat 105 is in the upright mode. The seat control device 31 performs the activation processing of the seat control system 3 (S101). The seat control device 31 waits for instruction information from the seat control UI 32 according to the operation of a user (S102). Upon obtaining instruction information from the seat control UI 32 (S103), the seat control device 31 transmits a control command to the seat operation mechanism 30 (S104), thereby changing the reclining state of the seat. The seat control device 31 transmits the seat information to the noise reduction device 10 (S105). Unless the seat control system 3 is terminated (S106), the seat control device 31 repeats the processing of steps S101 to S105.

It is to be noted that the operation of the seat control system 3 is not limited to the procedure of the flowchart shown FIG. 19. Some procedures may be exchanged, or they may be executed in parallel. For example, either the transmission of the control command in step S104 or the transmission of the seat information in step S105 may be performed first or both may be performed in parallel.

Figure 20:
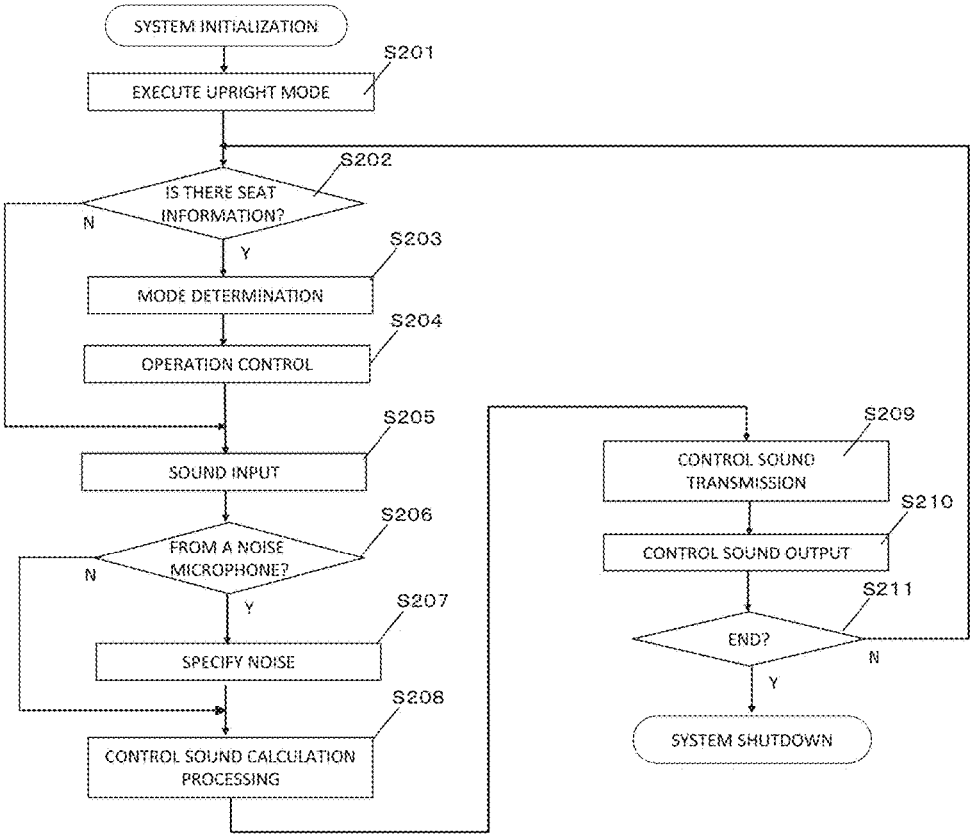
FIG. 20 is a flowchart illustrating an operation of a noise reduction system.

FIG. 20 is a flowchart illustrating an operation of the noise reduction system 1 according to the present embodiment. First, the noise reduction device 10 is in the initialization state. This initialization state is, for example, a state immediately after takeoff of the aircraft, and the seat 105 is in the upright mode. The noise reduction device 10 at this time executes the operation and type of operation of the speakers 5 and microphones 7 according to the upright mode shown in FIG. 10 (S201). When the seat information is obtained from the seat control system 3 (S202), the noise reduction device 10 executes the function of the operation control unit 16 and determines the mode (S203) as shown in FIG. 10. Then, the operation of the respective speakers 5 and the respective microphones 7 is controlled according to the determined mode (S204). Here, controlling the operation includes: switching the output of the control sound signal to the speakers 5 to ON or OFF, switching the input of the sound signal from the microphones 7 to ON or OFF, and determining whether the sound signal from the microphone 7 is from a noise microphone or an error microphone. When a sound signal is inputted from the microphone 7 the input of which is switched to ON (S205), the operation control unit 16 determines whether the inputted sound signal is from a noise microphone or from an error microphone (S206). When it is from a noise microphone, the noise specifying unit 13*a* performs the above-described processing (S207) and then the control sound calculating unit 13*b* performs the above-described processing (S208). In contrast, in step S206, when the sound signal is from an error microphone, control sound calculation processing including adjustment of the filter coefficient is performed. In the control sound calculation processing, a control sound signal having the opposite phase to the sound signal is generated based on the sound signal which is the noise signal acquired from the noise microphone, and based on the error sound signal which is acquired from the error microphone. The noise reduction device 10 outputs the control sound signal to the speaker 5, the output of which is switched to ON, by the control sound transmitter 14 (S209). Then, the speaker 5, the output of which is switched to ON, outputs a control sound (S210). Unless the processing of the noise reduction device 10 is terminated (S211), the noise reduction device 10 repeats the processing of steps S202 to S211.

It is to be noted that the operation of the noise reduction system 1 is not limited to the procedure of the flowchart shown FIG. 20. Some procedures may be exchanged, or they may be executed in parallel. For example, the procedures from the sound signal input to the control sound output in steps S205 to S210 may be executed in parallel with the procedures of mode determination and operation control based on the seat information in steps S202 to S204.

1-3 Characteristics

The noise reduction device 10 according to the present disclosure dynamically determines the operation type of the microphone 7 based on seat information, whereby the control sound generating unit 13 generates a control sound in accordance with this determination. Therefore, even if the position of the control point changes due to the change in the reclining state of the seat, the microphone 7 close to the control point can be set as the error microphone, resulting in the enhancement of the noise reduction effect. Furthermore, unlike the prior art, the position of the error microphone can be dynamically changed, which allows the noise reduction effect to be maintained without installing an error microphone in the seat.

The noise reduction device 10 also switches the operation of the microphone 7 based on the seat information. Therefore, even if the seat is raised and its backrest covers the microphone 7 and sound transmission failure occurs, the noise reduction effect can be maintained by switching the reception of the sound signal from the microphone 7 to OFF. In addition, a microphone with a low noise reduction effect is not used, and thereby extra power consumption and adverse influence on noise reduction effect can be suppressed.

The noise reduction device 10 further switches the operation of the speaker 5 based on the seat information. Therefore, even if the position of the control point changes due to the change in the reclining state of the seat, the output to the speaker 5 close to the control point is switched to ON and the output of the speaker 5 at a distance from the control point is switched to OFF. With this configuration, extra power consumption and adverse influence on the noise reduction effect can both be suppressed.

1-4. Modification Example

A noise reduction device 210 according to a modified example will be described with reference to FIGS. 21 to 23. In the noise reduction device 210, a change in the state of the sound field formed in the shell structure 110 is detected by a change in a received sound signal. This point makes the noise reduction device 210 different from that of the aforesaid embodiment. Hereinafter, differences from the aforesaid embodiment will be mainly described.

The microphone 7 and the speaker 5 do not function properly when the microphone 7 and speaker 5 are being obstructed by a part of the seat or other objects, which causes a decrease in the correlation between noise and a control sound, thereby a reduced noise reduction effect. Given this situation, the noise reduction device 210 according to the present modification prevents the noise reduction effect from being reduced.

Figure 21:
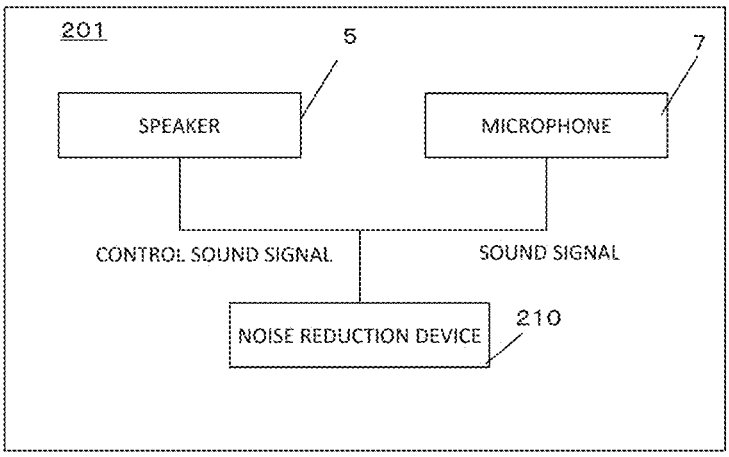
FIG. 21 schematically shows a configuration of a noise reduction system according to a modified example.

As shown in FIG. 21, a noise reduction system 201 includes the noise reduction device 210, the speakers 5, and the microphones 7.

Figure 22:
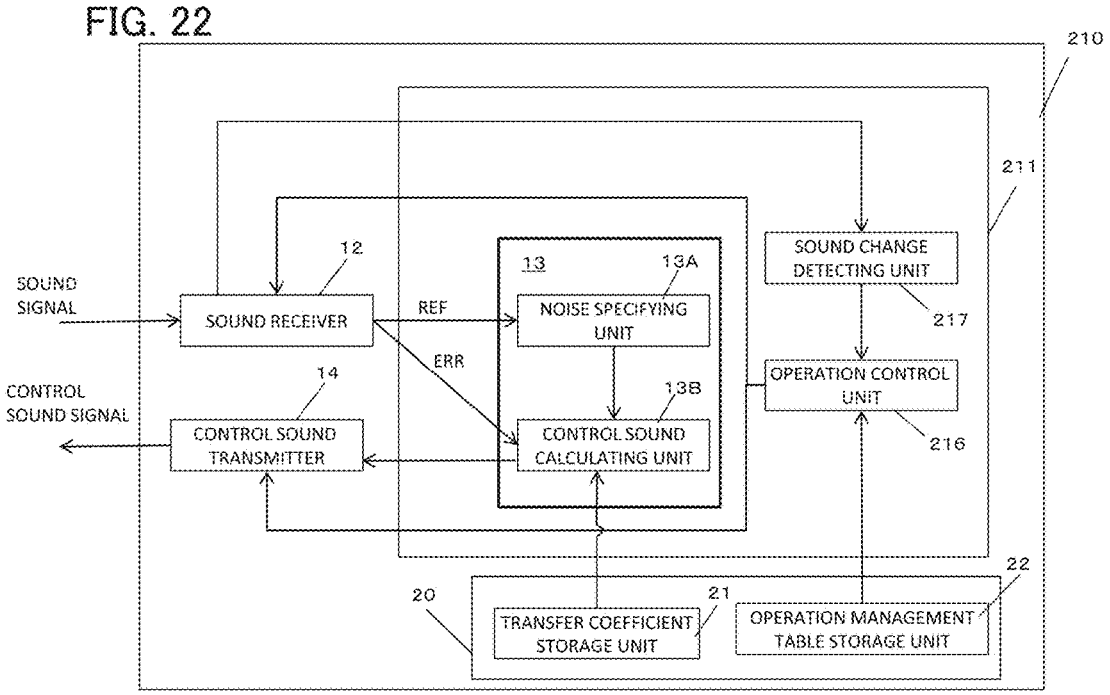
FIG. 22 is a functional block diagram of a noise reduction device according to a modified example.

As shown in FIG. 22, the noise reduction device 210 includes a processor 211 including a signal processing circuit such as a Digital Signal Processor (DSP), the sound receiver 12 connectable to the respective microphones 7, the control sound transmitter 14 connectable to the respective speakers 5, and the memory 20. The processor 211 has a similar configuration as the aforesaid embodiment, but differs in that it executes the function of a sound change detecting unit 217. The sound change detecting unit 217 is an example of a detecting unit for detecting a change in the state of the sound field formed in the shell structure 110.

The sound change detecting unit 217 monitors sound signals received from the respective microphones 7 and detects changes in the received sound signals. The change in the received sound signal means, for example, that the intensity change or the noise reduction width of a sound signal from a specific microphone 7 is different from the intensity change or the noise reduction width of a sound signal from the other microphone 7; or that the relevant sound signal is smaller than the reference level of the sound signal from the specific microphone 7 which is acquired in advance. Furthermore, when a specific speaker 5 is obstructed by a part of the seat or other objects, a change occurs in the input sound of the error microphone that is close to the specific speaker 5 out of the plurality of error microphones. That is, the input sound becomes smaller, compared with the ones of the other error microphone and this change is detected by the sound change detecting unit 217.

Referring to a predetermined table stored in the operation management table storage unit 22, an operation control unit 216 determines the operation and the type of operation of the respective speakers 5 and respective microphones 7. The predetermined table includes conditions for determining the operation and type of operation for the speaker 5 and microphone 7 (for example, a reference level of the sound signal, the degree of intensity change of the sound signal, the width of noise reduction, the duration of change, etc. are conditions for the determination). The operation control unit 216 determines the operation and the type of operation of the speaker 5 or the microphone 7 according to this condition, and issues commands to the sound receiver 12 and the control sound transmitter 14. For example, the operation control unit 216 switches OFF the input of the sound signal from a microphone 7 specified on the basis of the detection by the sound change detecting unit 217. The operation control unit 216 also switches OFF, for example, the output of a speaker 5 specified on the basis of the detection by the sound change detecting unit 217. In the case where, for example, the specific microphone 7 determined based on the detection by the sound change detecting unit 217 is an error microphone, the operation control unit 216 sets the specific microphone 7 as a noise microphone.

Similarly, when the specific microphone 7 or the specific speaker 5 is no longer in a state of being obstructed by a part of the seat or other objects, the sound change detecting unit 217 detects a change in the sound signal that is received. Based on this detection by the sound change detecting unit 217, the operation control unit 216 executes operation control such as switching ON the input of the sound signal from the specific microphone 7, switching ON the output of the specific speaker 5 as well, and setting the noise microphone to an error microphone.

Figure 23:
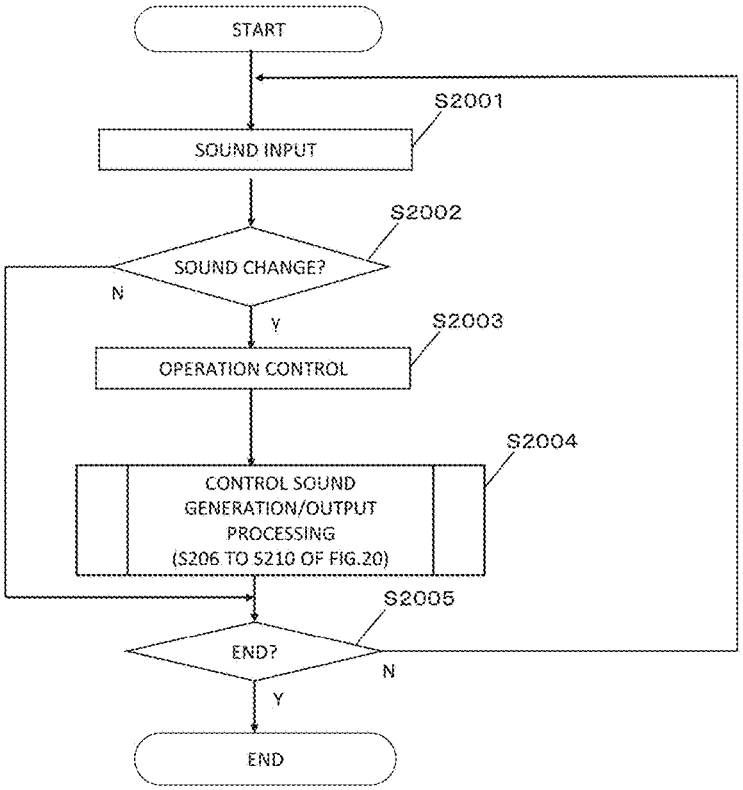
FIG. 23 is a flowchart illustrating an operation of a noise reduction system according to a modified example.

FIG. 23 is a flowchart illustrating an operation of the noise reduction system 201 including the noise reduction device 210 according to the present modified example. Upon input of a sound signal (S2001), the noise reduction device 210 detects whether there is a change in the sound signal as described above (S2002). When a change is detected, the functions of the operation control unit 216 as described above are executed (S2003). Subsequently, control sound generation/output processing in steps S206 to S210 of the flowchart shown in FIG. 20 is executed (S2004). Unless the processing of the noise reduction device 210 is terminated (S2005), the noise reduction device 210 will repeat the processing of steps S2001 to S2004.

The noise reduction device 210 according to the above modified example includes the sound change detecting unit 217 for detecting a change in the sound signal received by the sound receiver 23, and controls the control sound generating unit 13 in generating a control sound signal based on the change in the sound signal, or switches the operation of the microphone 7 or speaker 5. This configuration enables control of the operation of the microphone 7 and the speaker 5 whose functions cannot be exerted normally due to causes such as being obstructed by a part of the seat or other objects. As a result, the correlation between the noise and the control sound can be maintained, thereby keeping the noise reduction effect.

Note that the noise reduction device 210 according to the above modification may include the seat information acquisition unit 17 of the aforementioned embodiment in addition to the sound change detecting unit 217. In this case, switching the operation of the respective speakers 5 and the respective microphones 7, and generating a control sound based on the type of operation are executed based on the seat information in addition to the change in the sound signal.

Other Embodiments

As described above, the above embodiment has been described to exemplify the technology disclosed in the present application. However, the technology is not limited to the embodiment, and is also applicable to embodiments that are subjected, as appropriate, to various changes and modifications, replacements, additions, omissions, and the like. Moreover, the technology disclosed herein also allows another embodiment which is configured by combining the appropriate constituent elements in the embodiment described above.

For example, although the noise reduction system 1 includes the noise reduction device 10, the speakers 5, and the microphones 7, the noise reduction system 1 may further include the seat control system 3.

The arrangement, the number, the operation, and the type of operation of the speakers 5 and the microphones 7 are not limited to the above examples, but may be changed as long as the noise reduction effect can be maintained according to the reclining state of the seat. The number of microphones 7 determined as either error microphones or noise microphones according to a reclining state of a seat or a change of state of the sound field is not limited to the above examples, and may be either single or plural. Likewise, the number of speakers 5 and the number of microphones 7 to be either activated or deactivated according to the reclining state or the change of state of the sound field is not limited to the above examples, and may be either single or plural.

In the embodiment described above, the noise reduction devices 10 and 210 and the noise reduction systems 1 and 201 are taken as examples. However, the present disclosure includes a noise reduction control method executed by such noise reduction devices 10 and 210 or noise reduction systems 1 and 201.

In the embodiment described above, description has been made using the example in which the noise reduction systems 1 and 201 of the present disclosure are installed in the cabin of the aircraft 100. However, the present disclosure is not limited to this. The installation site of the noise reduction systems 1 and 202 is not limited to the cabin of an aircraft. For example, the noise reduction system may be installed in the cockpit of the aircraft, for reducing a burden on the ears of a pilot. Alternatively, the noise reduction system may be installed in vehicles other than aircraft, including helicopters, trains, and buses. Moreover, besides movable bodies such as vehicles, the noise reduction system may be installed in other places including buildings located in the neighborhood of a construction site or a club with live music, etc., which emits a noise.

According to the noise reduction devices 10 and 210, the noise reduction systems 1 and 201, and the noise reduction control method of the present disclosure, it is possible to dynamically optimize the positions of the speakers and microphones for noise reduction in a seat having a shell structure, thereby efficiently obtaining the noise reduction effect.

What is claimed:

1. A noise reduction device connectable to a plurality of sound acquisition devices and a plurality of sound output devices that acquire and output sound in a given space around a seat, the noise reduction device comprising:

a memory that stores, with respect to each of at least an upright seat position control point and a reclined seat position control point at which noise is to be reduced: settings of each of the plural sound acquisition devices as either a noise acquisition device, an error acquisition device, or off; settings of each of the sound output devices as on or off; and a filter transfer coefficient;

a processor that:

selects, based on a current position of the seat, the filter transfer coefficient, the sound acquisition device and sound output device settings associated with either the upright seat position control point and the reclined seat position control point stored in the memory, determines, for each respective sound signal from the sound acquisition devices, whether the respective sound signal is from a noise sound acquisition device or an error sound acquisition device, specifies, for the noise sound acquisition device, a frequency in the sound signal from the noise sound acquisition device as a frequency to be canceled, adjusts the selected transfer coefficient based on the sound signal from a sound acquisition device determined to be an error sound acquisition device, and generates a cancelation sound signal according to the specified frequency and the adjusted transfer coefficient; and a control sound transmitter that outputs the cancelation sound signal to at least one of the plurality of sound output devices.

2. The noise reduction device according to claim 1, wherein the processor detects a state change of a sound field in the space, and switches ON or OFF reception of a sound signal from at least one of the plurality of sound acquisition devices, according to a change of state of the sound field.

3. The noise reduction device according to claim 1, wherein the processor detects a state change of a sound field in the space, and switches ON or OFF the output of the cancelation sound signal of at least one of the plurality of sound output devices, according to the change of state of the sound field.

4. The noise reduction device according to claim 1, wherein the memory further stores, with respect to a partially reclined seat position control point at which noise is to be reduced: settings of each of the plural sound acquisition devices as either a noise sound acquisition device, an error sound acquisition device, or off; settings of each of the sound output devices as on or off, the partially reclined seat position control point being between the upright seat position control point and the reclined seat position control point; and the processor selects, based on a current position of the seat, the sound acquisition device and sound output device settings associated with either the upright seat position control point, the reclined seat position control point, or the partially reclined seat position stored in the memory.

5. A noise reduction system comprising:

the noise reduction device according to claim 1;

the plurality of sound acquisition devices connectable to the noise reduction device; and the plurality of sound output devices connectable to the noise reduction device.

6. The noise reduction system according to claim 5, wherein the plurality of sound acquisition devices includes one or more upper sound acquisition devices disposed in an upper part of the given space, and one or more lower sound acquisition devices disposed in a lower part of the given space;

when the processor selects the reclined seat position control point, the processor determines at least one of the upper sound acquisition devices as the noise sound acquisition device, and determines at least one of the lower sound acquisition devices as the error sound acquisition device.

7. The noise reduction system according to claim 5, wherein the plurality of sound acquisition devices includes one or more upper sound acquisition devices disposed in an upper part of the given space, and one or more lower sound acquisition devices disposed in a lower part of the given space;

when the processor selects the upright seat position control point, the processor determines at least one of the upper sound acquisition devices as the error sound acquisition device, and switches OFF reception of a sound signal from at least one of the lower sound acquisition devices.

8. The noise reduction system according to claim 5, wherein the memory further stores, with respect to a partially reclined seat position control point at which noise is to be reduced: settings of each of the plural sound acquisition devices as either a noise sound acquisition device, an error sound acquisition device, or off; settings of each of the sound output devices as on or off, the partially reclined seat position control point being between the upright seat position control point and the reclined seat position control point; and the processor selects, based on a current position of the seat, the sound acquisition device and sound output device settings associated with either the upright seat position control point, the reclined seat position control point, or the partially reclined seat position stored in the memory;

the plurality of control sound output devices includes one or more first control sound output devices disposed in an upper part of the given space, and one or more second control sound output devices disposed in a lower part of the given space;

the plurality of sound output devices includes one or more first sound output devices disposed in the upper part of the given space, and one or more second sound output devices disposed in the lower part of the given space;

when the processor selects the partially reclined seat position control point, the processor switches OFF the output of the cancelation sound signal to the one or more first sound output devices, and switches ON the output of the cancelation sound signal to the one or more second control sound output devices; and when the processor selects the upright seat position control point, the processor switches ON the output of the cancelation sound signal to the one or more first control sound output devices, and switches OFF the output of the cancelation sound signal to the one or more second control sound output devices.

9. A noise reduction method for use with a plurality of sound acquisition devices and a plurality of sound output devices that acquire and output sound in a given space around a seat, the noise reduction method comprising:

storing in a memory, with respect to each of at least an upright seat position control point and a reclined seat position control point at which noise is to be reduced: settings of each of the plural sound acquisition devices as either a noise acquisition device, an error acquisition device, or off; settings of each of the sound output devices as on or off; and a filter transfer coefficient;

with a processor:

selecting, based on a current position of the seat, the filter transfer coefficient, the sound acquisition device and sound output device settings associated with either the upright seat position control point and the reclined seat position control point stored in the memory, determining, for each respective sound signal from the sound acquisition devices, whether the respective sound signal is from a noise sound acquisition device or an error sound acquisition device, specifying, for the noise sound acquisition device, a frequency in the sound signal from the noise sound acquisition device as a frequency to be canceled, adjusting the selected transfer coefficient based on the sound signal from a sound acquisition device determined to be an error sound acquisition device, and generating a cancelation sound signal according to the specified frequency and the adjusted transfer coefficient; and outputting the cancelation sound signal to at least one of the plurality of sound output devices.

* * * * *